US010842692B2

(12) United States Patent
Bryant

(10) Patent No.: US 10,842,692 B2
(45) **Date of Patent: *Nov. 24, 2020**

(54) ELEVATABLE AND PORTABLE WHEELCHAIR

(71) Applicant: Daniel Bryant, Port Henry, NY (US)

(72) Inventor: Daniel Bryant, Port Henry, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/550,874

(22) Filed: Aug. 26, 2019

(65) Prior Publication Data

US 2019/0380895 A1 Dec. 19, 2019

Related U.S. Application Data

(63) Continuation-in-part of application No. 15/490,983, filed on Apr. 19, 2017, now Pat. No. 10,391,007.

(60) Provisional application No. 62/325,054, filed on Apr. 20, 2016.

(51) Int. Cl.

| | |
|---|---|
| ***A61G 5/02*** | (2006.01) |
| ***A61G 5/10*** | (2006.01) |
| *A61G 7/10* | (2006.01) |

(52) U.S. Cl.

CPC ..... *A61G 5/104* (2013.01); *A61G 5/1059* (2013.01); *A61G 5/02* (2013.01); *A61G 7/103* (2013.01)

(58) Field of Classification Search

CPC ..... A61G 5/104; A61G 5/1059; A61G 5/02
See application file for complete search history.

(56) References Cited

U.S. PATENT DOCUMENTS

| | | | | |
|---|---|---|---|---|
| 5,520,403 | A | 5/1996 | Bergstrom et al. | |
| 6,142,568 | A * | 11/2000 | Abelbeck | A61G 5/1059 297/330 |
| 6,315,319 | B1 | 11/2001 | Hanson et al. | |
| 6,325,399 | B1 | 12/2001 | DeMoss | |
| 6,431,650 | B1 | 8/2002 | Visone | |
| 6,793,232 | B1 | 9/2004 | Wing | |
| 6,802,518 | B2 | 10/2004 | Kuntz | |
| 7,090,241 | B2 * | 8/2006 | Silva | A61G 5/1059 280/250.1 |
| 7,222,868 | B2 * | 5/2007 | Norman | A61G 5/1072 280/250.1 |
| 7,273,255 | B2 * | 9/2007 | Nylander | A61G 5/1059 297/330 |
| 7,305,726 | B2 | 12/2007 | Augustine et al. | |
| 7,306,251 | B2 * | 12/2007 | Bright | A61G 5/006 280/304.1 |
| 8,186,701 | B2 | 5/2012 | Sim et al. | |
| 8,398,108 | B2 | 3/2013 | Andrews | |
| 8,696,017 | B2 | 4/2014 | Wright | |
| 10,391,007 | B2 | 8/2019 | Bryant | |

(Continued)

*Primary Examiner* — Ruth Ilan
*Assistant Examiner* — Marlon A Arce
(74) *Attorney, Agent, or Firm* — Wolf, Greenfield & Sacks, P.C.

(57) ABSTRACT

A wheelchair includes a lower assembly including a lower frame having wheels rotatably mounted thereto, an upper assembly including an upper frame supporting a seat, a backrest and at least one movable armrest, and a lift mechanism configured to move the upper assembly relative to the lower assembly between a lowered position and a raised position, wherein a user can move sideways out of the seat in the raised position with the movable armrest lowered.

18 Claims, 17 Drawing Sheets

(56) References Cited

U.S. PATENT DOCUMENTS

| | | | | |
|---|---|---|---|---|
| 2002/0149168 | A1* | 10/2002 | Brown | A61G 5/1059<br>280/250.1 |
| 2008/0133089 | A1 | 6/2008 | Bayomy et al. | |
| 2017/0304132 | A1 | 10/2017 | Bryant | |

* cited by examiner

ELEVATABLE AND PORTABLE WHEELCHAIR

CROSS REFERENCE TO RELATED APPLICATIONS

This application is a continuation-in-part of U.S. patent application Ser. No. 15/490,983, filed Apr. 19, 2017, which claims priority based on Provisional Application No. 62/325,054, filed Apr. 20, 2016, which are hereby incorporated by reference in their entirety.

BACKGROUND

Conventional wheelchairs provide satisfactory performance in transporting a user within buildings and localized areas. The conventional wheelchair can be pushed by a caregiver or can be operated by a user having sufficient arm strength. Further, conventional wheelchairs can be folded to facilitate storage and transport in vehicles.

However, when the user is relatively weak and/or is unable to stand on their own, conventional wheelchairs have drawbacks. For example, the caregiver may be required to lift the user from the wheelchair and to position the user in a vehicle, a bed, or other location. This may be particularly difficult if the user is large and heavy and/or the caregiver is small and/or lacking in strength. Further, moving the user from the wheelchair to a vehicle may be difficult depending on the height and placement of the vehicle seat, and the configuration of the vehicle door.

As a result, moving a user from a wheelchair to a vehicle, and vice versa, may cause stress and/or injury to the user. In addition, it has been reported that employees in nursing and personal care facilities suffer more than 200,000 patient-handling injuries yearly.

Motorized wheelchairs permit the user to move about on their own, even when the user has limited strength. However, in the case of severely disabled users, a caregiver is required to lift the user from the wheelchair and to move the user to a vehicle, bed or other location, as in the case of conventional wheelchairs. Further, motorized wheelchairs are relatively expensive and require a large or specialized vehicle for transport.

Special wheelchair vehicles may include a wheelchair lift and may provide sufficient area for the user to remain in the wheelchair during travel. However, such special wheelchair vehicles are expensive and are practical primarily for hospitals, nursing homes and other institutions.

Accordingly, there is a need for improved wheelchairs that address one or more of the above problems.

SUMMARY

In accordance with embodiments, a wheelchair comprises a lower assembly including a lower frame having wheels rotatably mounted thereto, an upper assembly including an upper frame supporting a seat, a backrest and at least one movable armrest, and a lift mechanism configured to move the upper assembly relative to the lower assembly between a lowered position and a raised position, wherein a user can move sideways out of the seat in the raised position with the movable armrest lowered.

In embodiments, the lift mechanism is manually controlled. The lift mechanism may comprise a jack such as, for example, a scissors jack. The lift mechanism may further comprise a crank connected to the scissors jack.

In further embodiments, the lift mechanism is electrically controlled. The lift mechanism may include a motor and a battery for operation of the motor. The lift mechanism may further include a battery charger and a power cord for connection of the battery charger to a power source in the vehicle or in a fixed location. In further embodiments, the motor can be directly connected to a power source in the vehicle or in a fixed location. The motor, for example, may operate the scissors jack. In further embodiments, the lift mechanism comprises a linear chain actuator.

In further embodiments, the lower assembly, the upper assembly and the lift mechanism are configured to enable folding of the wheelchair for storage and/or transport.

In further embodiments, the movable armrest pivots downwardly. The movable armrest may be hinged to the upper frame to permit pivotal movement. In further embodiments, the movable armrest is slidable upwardly and downwardly. The armrest may be contoured to clear the wheels during pivotal movement.

In further embodiments, the wheelchair includes footrests. The footrests may be pivotally mounted to the upper frame.

In further embodiments, the lower frame and the upper frame include telescoping frame members. The telescoping frame members may include a first tube of a first diameter and a second tube of a second diameter, wherein the first diameter is different from the second diameter.

In further embodiments, the upper assembly includes upper struts pivotally connected between the upper frame and the lift mechanism. The lower assembly may further include lower struts pivotally connected between the lower frame and the lift mechanism.

In further embodiments, the lift mechanism is configured to enable adjustment of the seat to an intermediate position between the lowered position and the raised position.

In further embodiments, the wheelchair further comprises a transfer board that engages the upper frame with the movable armrest lowered.

In further embodiments, the lower frame includes a lower left frame and a lower right frame, each connected to the lift mechanism and the upper frame includes an upper left frame and an upper right frame, each connected to the lift mechanism. The lower left frame and the lower right frame may be pivotally connected to the lift mechanism by lower struts and the upper left frame and the upper right frame may be pivotally connected to the lift mechanism by upper struts.

BRIEF DESCRIPTION OF THE DRAWINGS

For a better understanding of the disclosed technology, reference is made to the accompanying drawings, which are incorporated herein by reference and in which.

DETAILED DESCRIPTION

Figure 5:
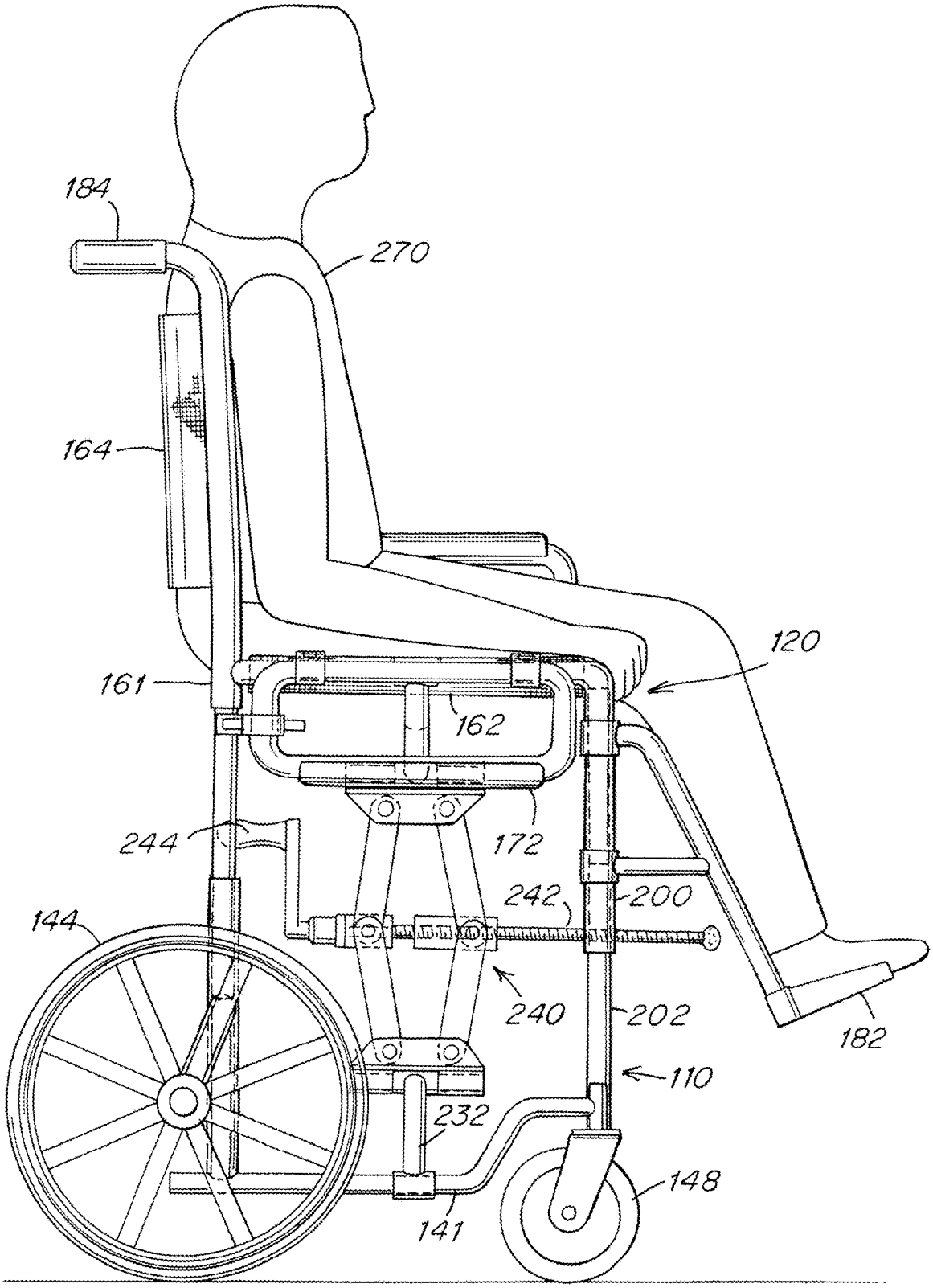
FIG. 5 is a side view of the wheelchair of FIG. 1, in the raised position and showing a user.
Figure 6:
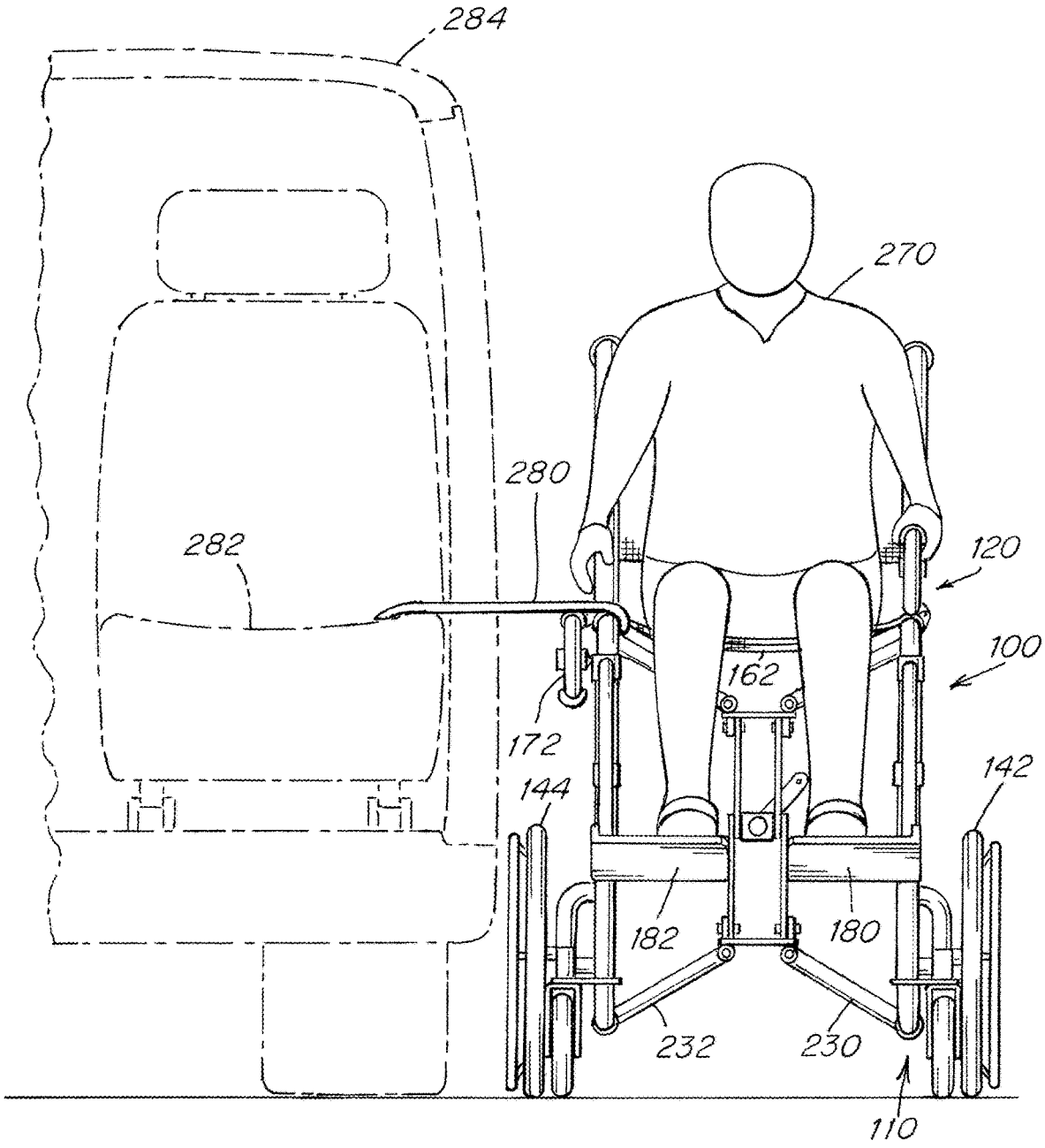
FIG. 6 is a schematic representation showing transfer of a user from the wheelchair of FIG. 1 to a vehicle seat.
Figure 7:
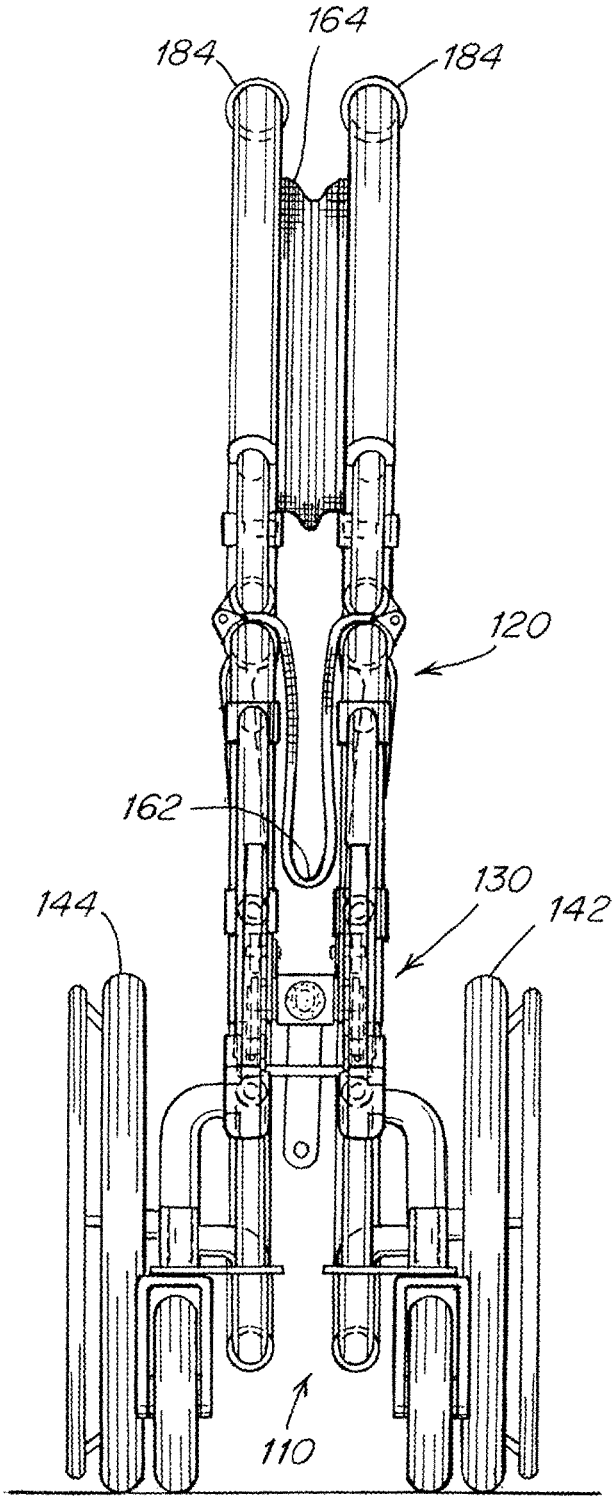
FIG. 7 is a front view of the wheelchair of FIG. 1 folded for storage and/or transport.

A wheelchair 100 in accordance with embodiments is shown in FIGS. 1-7, where like elements have the same reference numerals. A wheelchair 100 includes a lower assembly 110, an upper assembly 120 and a lift mechanism 130 operably connected between the lower assembly 110 and the upper assembly 120. The lift mechanism 130 permits the upper assembly 120 to be raised and lowered between a lowered position, as indicated by level H1 in FIG. 1, and a fully-up raised position, as indicated by level H2 in FIG. 3. Further, the lift mechanism 130 permits the upper assembly 120 to be adjusted to intermediate positions between the fully-up raised position and the lowered position. In addition, the wheelchair 100 can be folded for transport and/or storage as shown in FIG. 7.

The lower assembly 110 may include a lower left frame 140 and a lower right frame 141, which may be formed of tubular members. The lower left frame 140 and the lower right frame 141 together form a lower frame. Rear wheels 142 and 144 are rotatably mounted to lower left frame 140 and lower right frame 141, respectively. Also, front wheels 146 and 148 are rotatably mounted to lower left frame 140 and lower right frame 141, respectively. As in conventional wheelchairs, the rear wheels 142 and 144 may be larger than the front wheels 146 and 148, and the front wheels 146 and 148 may pivot about a vertical axis to permit maneuvering of the wheelchair 100.

The upper assembly 120 may include an upper left frame 160 and an upper right frame 161, which may be formed of tubular members. The upper left frame 160 and the upper right frame 161 together form an upper frame. The upper assembly 120 further includes a seat 162 and a backrest 164, both affixed between the upper left frame 160 and the upper right frame 161. The upper assembly 120 also includes left and right armrests 170 and 172 movably attached to upper left frame 160 and upper right frame 161, respectively. In embodiments, the left armrest 170, the right armrest 172, or both, may be movable between a conventional armrest position and a transfer position. The upper assembly 120 may further include left and right footrests 180 and 182 affixed to the upper left frame 160 and the upper right frame 161, respectively. The footrests 180 and 182 may be fixed in position or may fold inwardly. The upper assembly 120 may further include handles 184. The upper assembly 120 enables the seat 162, the backrest 164 and the armrests 170,172 to be raised and lowered as a unit, thereby ensuring that the user is stable during raising and lowering of the upper assembly 120.

To facilitate raising and lowering the upper assembly 120 relative to the lower assembly 110, the lower left frame 140, the lower right frame 141, the upper left frame 160 and the upper right frame 161 may include telescoping frame members. Referring for example to FIG. 5, the upper right frame 161 may include a frame member 200, and the lower right frame 141 may include a frame member 202. The frame member 202 has a smaller diameter than the frame member 200 and is tubular. The frame members 200 and 202 are dimensioned so that the frame member 202 can slide inside the frame member 200 during raising and lowering of the wheelchair. The upper frame and the lower frame may each include four telescoping frame members on the corners of the frame assembly to permit stable raising and lowering of the upper assembly 120 with a user in the seat 162. It will be understood that the larger diameter frame member may be on the upper frame or the lower frame.

Figure 2:
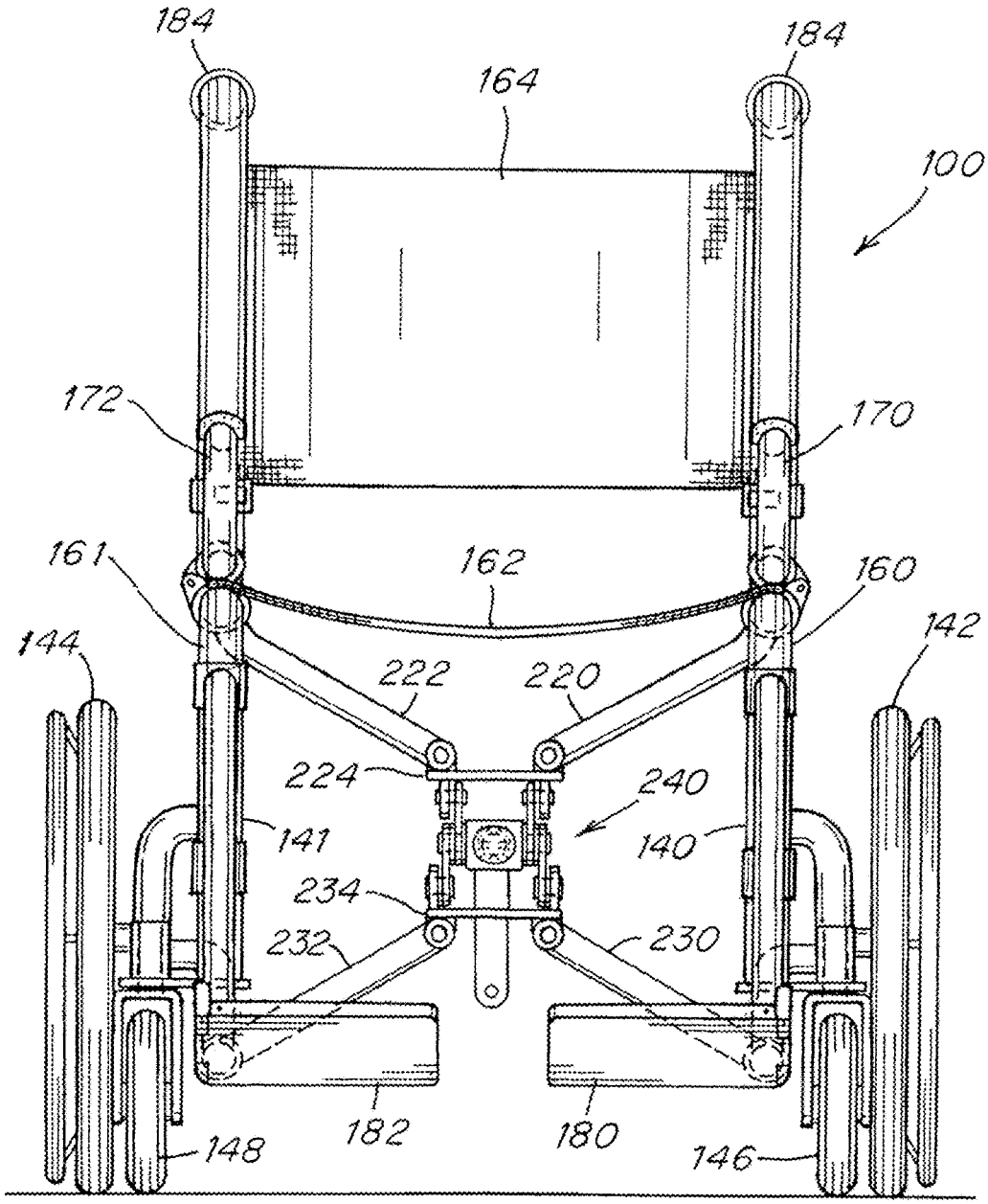
FIG. 2 is a front view of the wheelchair of FIG. 1.
Figure 3:
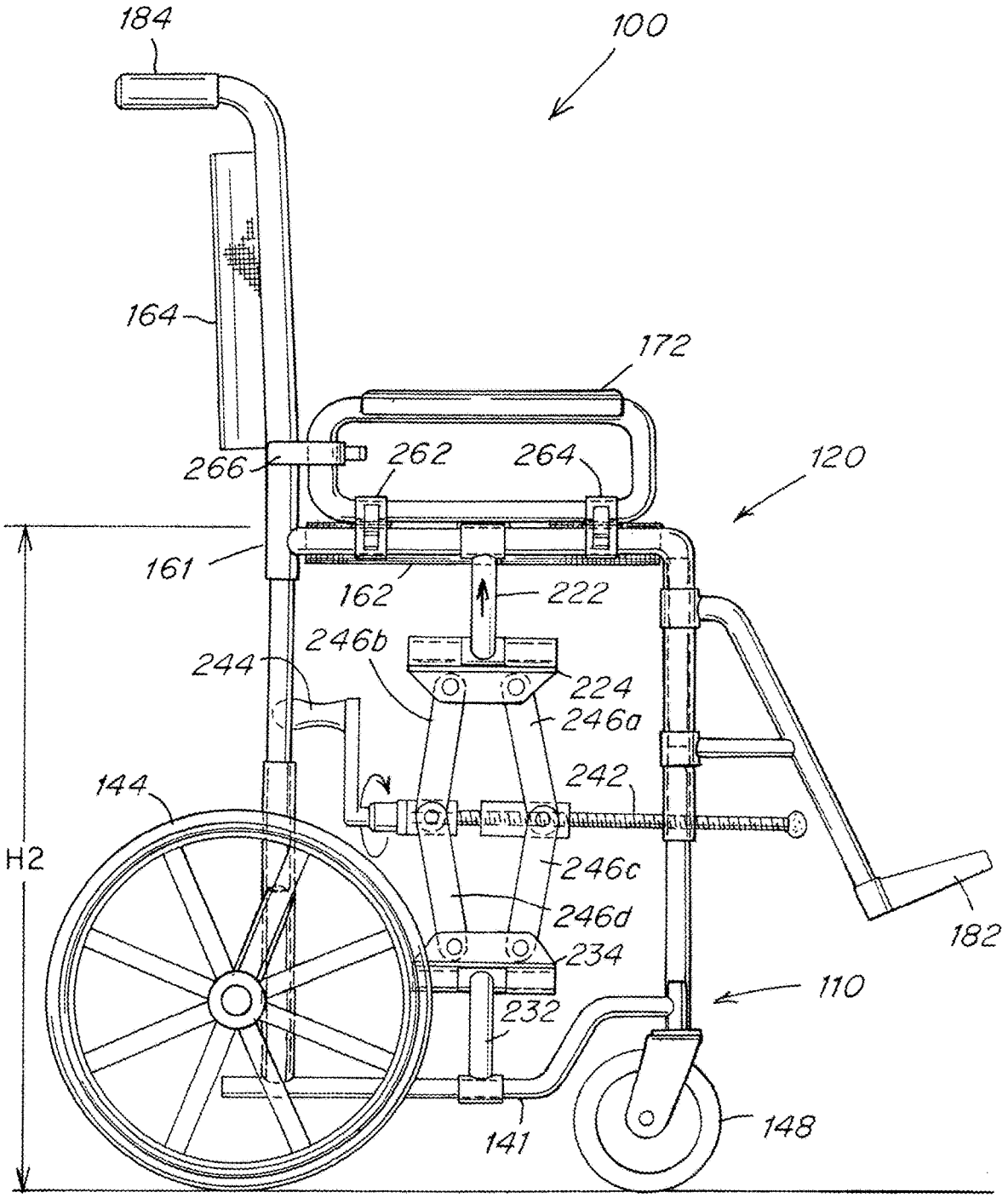
FIG. 3 is a side view of the wheelchair of FIG. 1, in the raised position.

The lift mechanism 130 is mechanically coupled between the upper assembly 120 and the lower assembly 110. As best shown in FIG. 2, the upper assembly 120 further includes upper struts 220 and 222, and the lower assembly 110 further includes lower struts 230 and 232. The lift mechanism 130 may be coupled to frame members of the upper assembly 120 by upper struts 220 and 222 and may be coupled to frame members of the lower assembly 110 by lower struts 230 and 232. The upper struts 220 and 222 are pivotally connected to lift mechanism 130 and are pivotally connected to horizontal frame members of upper assembly 120. Similarly, lower struts 230 and 232 are pivotally connected to lift mechanism 130 and are pivotally connected to horizontal frame members of lower assembly 110. In particular, upper strut 220 is pivotally connected to upper left frame 160, upper strut 222 is pivotally connected to upper right frame 161, lower strut 230 is pivotally connected to lower left frame 140, and lower strut 232 is pivotally connected to lower right frame 141.

In the embodiment of FIGS. 1-7, the lift mechanism 130 may be a mechanically-operated jack and more particularly may be a scissors jack 240. The scissors jack 240 has a conventional configuration including upper lift element 224, lower lift element 234, a screw 242, a hand crank 244 attached to screw 242 and scissors elements 246*a*, 246*b*, 246*c* and 246*d* coupled in a scissors jack configuration. The upper struts 220 and 222 are pivotally connected to upper lift element 224, and the lower struts 230 and 232 are pivotally connected to lower lift element 234. During operation of the hand crank 244, the upper lift element 224 is raised or lowered relative to the lower lift element 234, thereby raising or lowering the upper assembly 120 relative to the lower assembly 110. It will be understood that different types of jacks may be used within the scope of the disclosed technology.

It may be noted that the pivotally-connected upper struts 220 and 222 and the pivotally-connected lower struts 230 and 232 permit the wheelchair to be folded for storage and/or transport in a vehicle as shown in FIG. 7. In particular, the left and right sides of the upper assembly 120 and the lower assembly 110 can be pushed together to a storage/transport position. The upper struts 220 and 222 and the lower struts 230 and 232 pivot about their respective connection points, thereby holding the elements of the wheelchair together during folding and unfolding. As seen by comparison of FIGS. 2 and 4, the upper struts 220 and 222 and the lower struts 230 and 232 may not pivot during raising and lowering of the upper assembly 120 by the lift mechanism 130.

Figure 1:
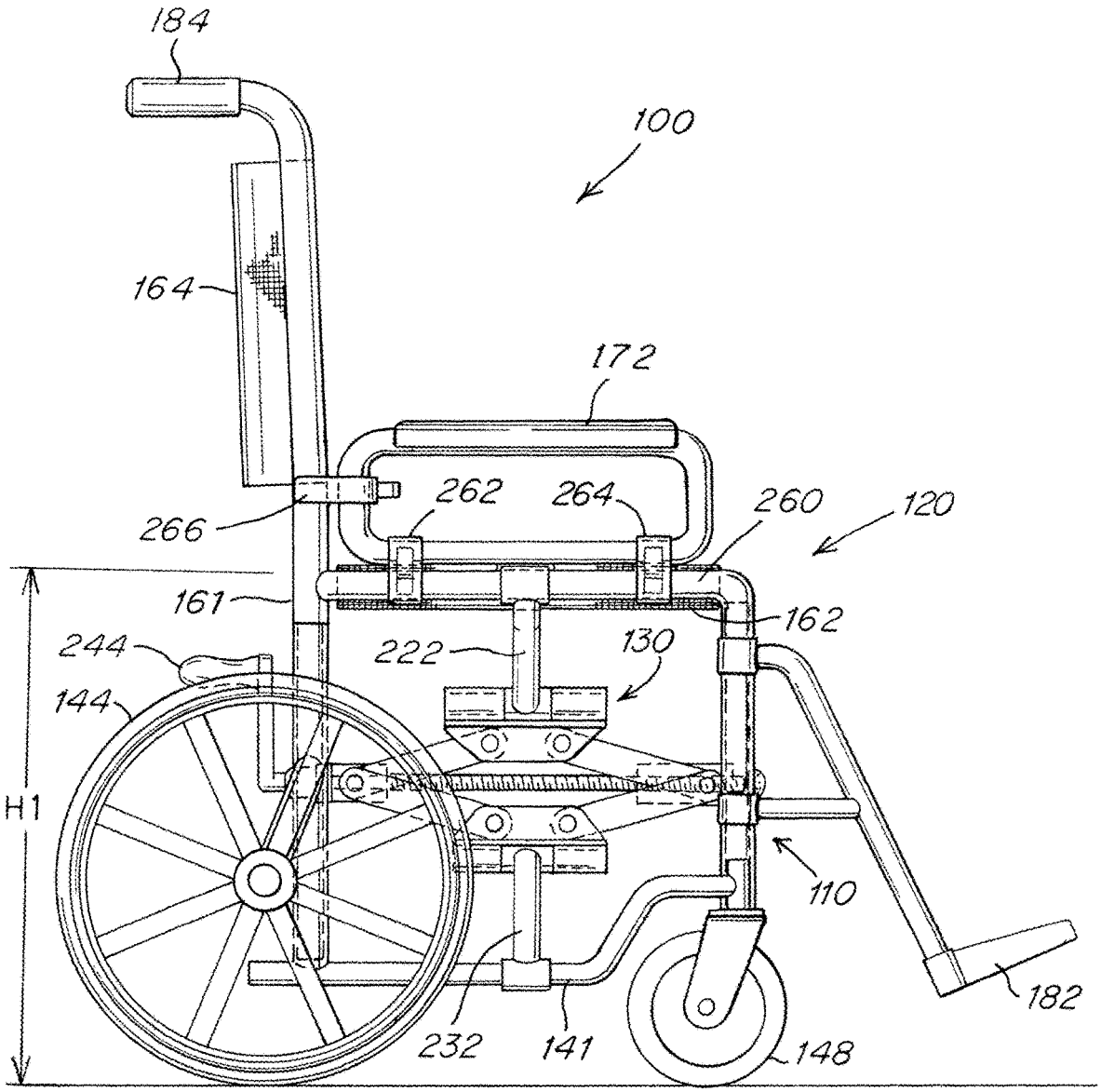
FIG. 1 is a side view of a wheelchair in a lowered position, in accordance with embodiments.
Figure 4:
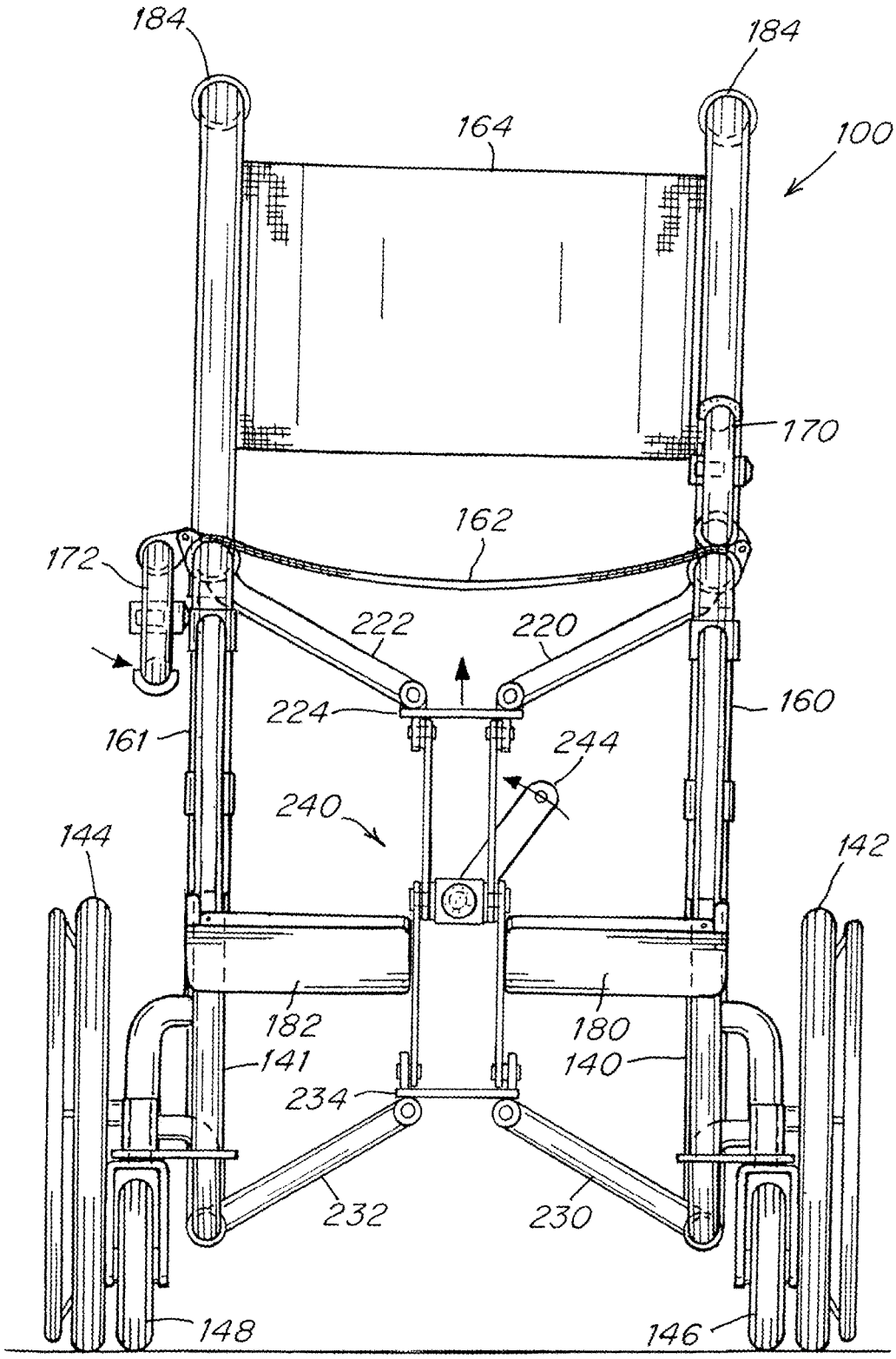
FIG. 4 is a front view of the wheelchair of FIG. 1, in the raised position.

At least one of the armrests 170 and 172 is movable to facilitate transfer of the user from the wheelchair 100 to a vehicle, a bed, or other location. In the embodiment of FIGS. 1-7, at least one of the armrests 170 and 172 can be pivoted downwardly with respect to the frame element on which it is mounted, as shown in FIGS. 4-6. As best shown in FIG. 1, the right armrest 172 is pivotally connected to a horizontal frame element 260 of upper right frame 161 by hinge elements 262 and 264. The right armrest 172 may be latched in the up position by a latch 266. The diameter of the rear wheels 142 and 144 may be selected to permit the armrest 172 to pivot outwardly and downwardly without interference with the rear wheel 144, within a range of levels to which the upper assembly 120 may be raised.

In FIGS. 4-6, the right armrest 172 has been moved to the transfer position for transfer of the user. When the armrest 172 is moved to the transfer position, a user 270 is able to move sideways out of the wheelchair without being obstructed by the armrest 172. As shown in FIG. 6, a transfer board 280 may be placed such that one end rests on the horizontal frame element 260 with the armrest 172 lowered and the other end rests on a seat 282 of a vehicle 284. The user 270 is then able to move horizontally from the seat 162 of wheelchair 100 across transfer board 280 to the seat 282 of vehicle 284, either with or without assistance depending on the condition of the user 270. Prior to transfer, the wheelchair 100 is raised to a level that is more or less the same as a level of the vehicle seat 282, so as to permit horizontal transfer of the user 270.

The wheelchair 100 can be used for transfer of the user to and from any vehicle, bed or other location within the height range of the wheelchair. However, the wheelchair 100 is particularly useful in the case of SUV's, vans, trucks and the like which have relatively high seats that may be difficult or impossible for a disabled person to access in the absence of wheelchair 100. The wheelchair 100 permits access to such vehicles by disabled users and reduces the risk of injury to the user and to the caregiver.

The wheelchair 100 has several modes of operation. In a first mode, the upper assembly 120 is lowered, if necessary, to the lowered position and the wheelchair can be moved about by the user or by a caregiver. The caregiver can push the wheelchair, or the user can rotate the wheels by hand.

In a second mode of operation, the user is transferred from the wheelchair 100 to the vehicle seat 282 or other location. The upper assembly 120 is moved relative to the lower assembly to a raised position by operation of the lift mechanism 130. The level of the raised position is selected according to the level of the vehicle seat or other location where the user is to be transferred. The armrest closest to the vehicle seat is then lowered, the transfer board 280 is placed between the seat 162 of the wheelchair and the seat 282 of the vehicle 284. Then, the user is moved across the transfer board 280, either by his or her own action or with assistance.

In a third operating mode, the user is transferred from the vehicle seat 282 or other location to the wheelchair 100. The seat 162 of wheelchair 100 is raised if necessary, the armrest closest to the vehicle seat is lowered, the transfer board 280 is placed between the seat 282 of vehicle 284 and the seat 162 of wheelchair 100, and the user is moved from the vehicle seat to the wheelchair 100, either by his or her own action or with assistance. The transfer board 280 is removed, the armrest is raised and the upper assembly 120 is moved to the lowered position by operation of the lift mechanism 130.

In a fourth operating mode, the level of the seat 162 of wheelchair 100 is adjusted to a level that is comfortable for the user by operation of the lift mechanism 130.

In a fifth operating mode, the wheelchair 100 is folded for transport and/or storage. The upper assembly 120 is moved to the fully-up raised position, and then the sides of the wheelchair are pushed together to the folded position as shown in FIG. 7.

Figure 8:
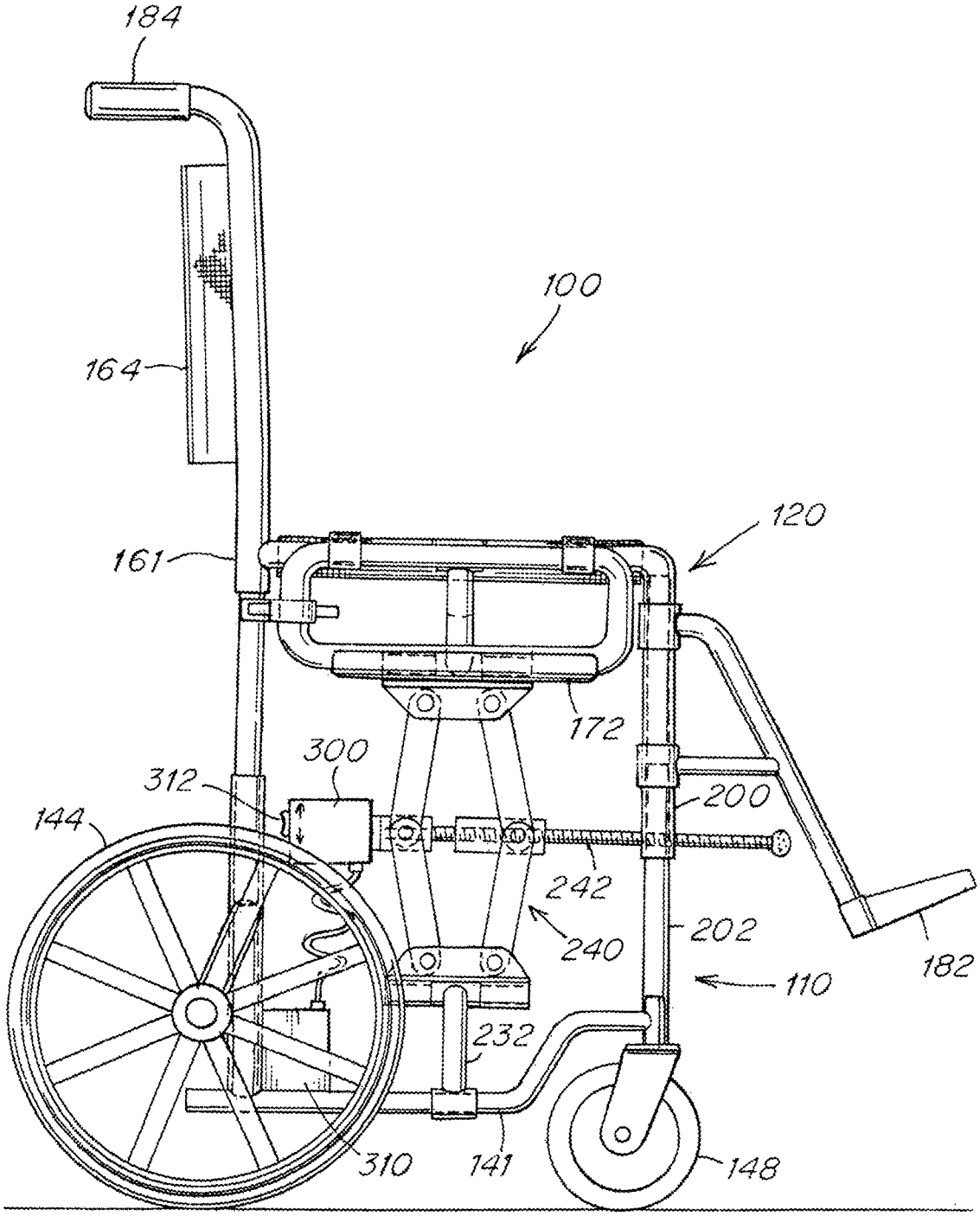
FIG. 8 is a side view of a wheelchair in the raised position, wherein the wheelchair includes a motorized lift mechanism in accordance with embodiments.
Figure 9:
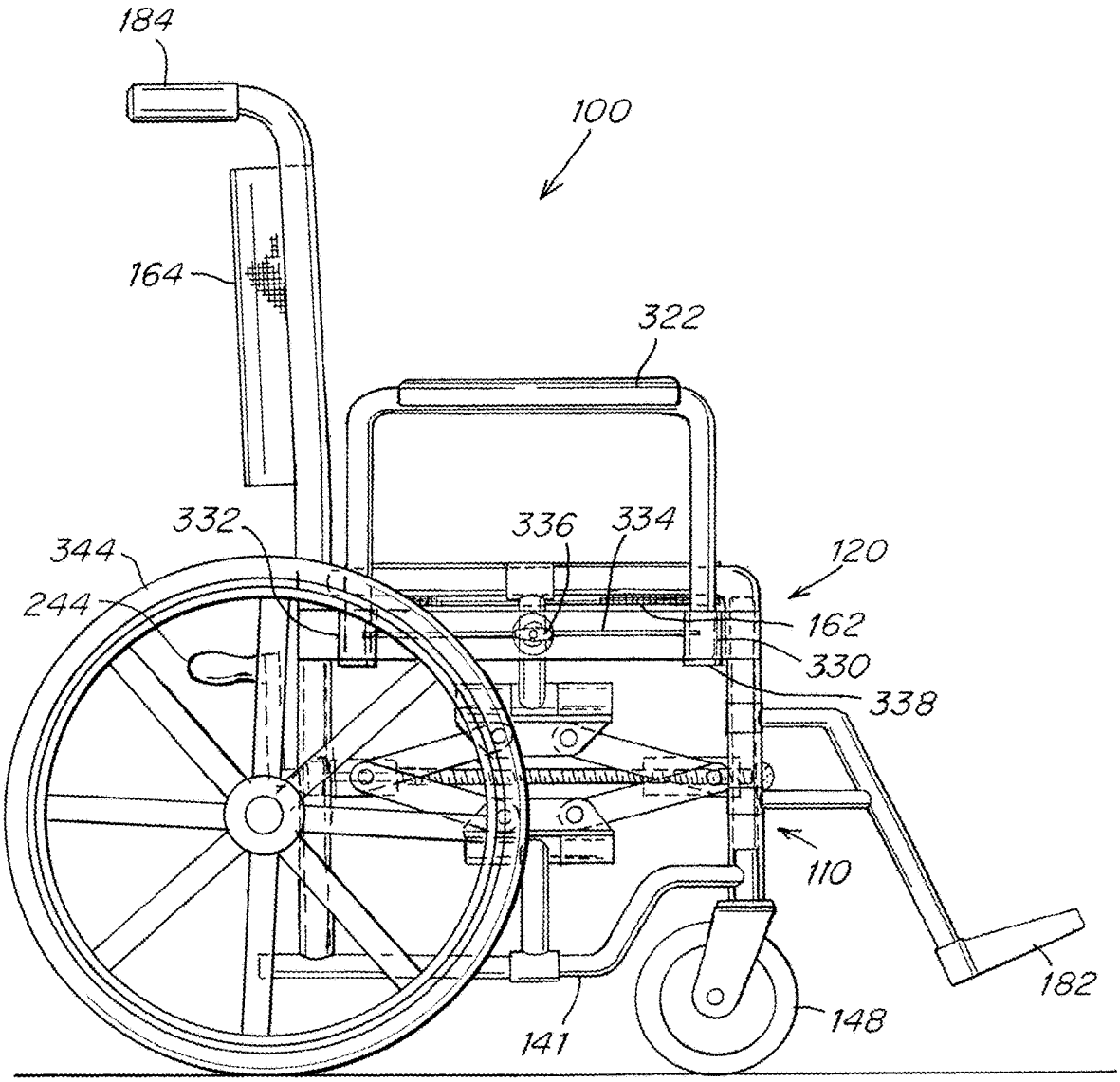
FIG. 9 is a side view of a wheelchair in accordance with additional embodiments.
Figure 10:
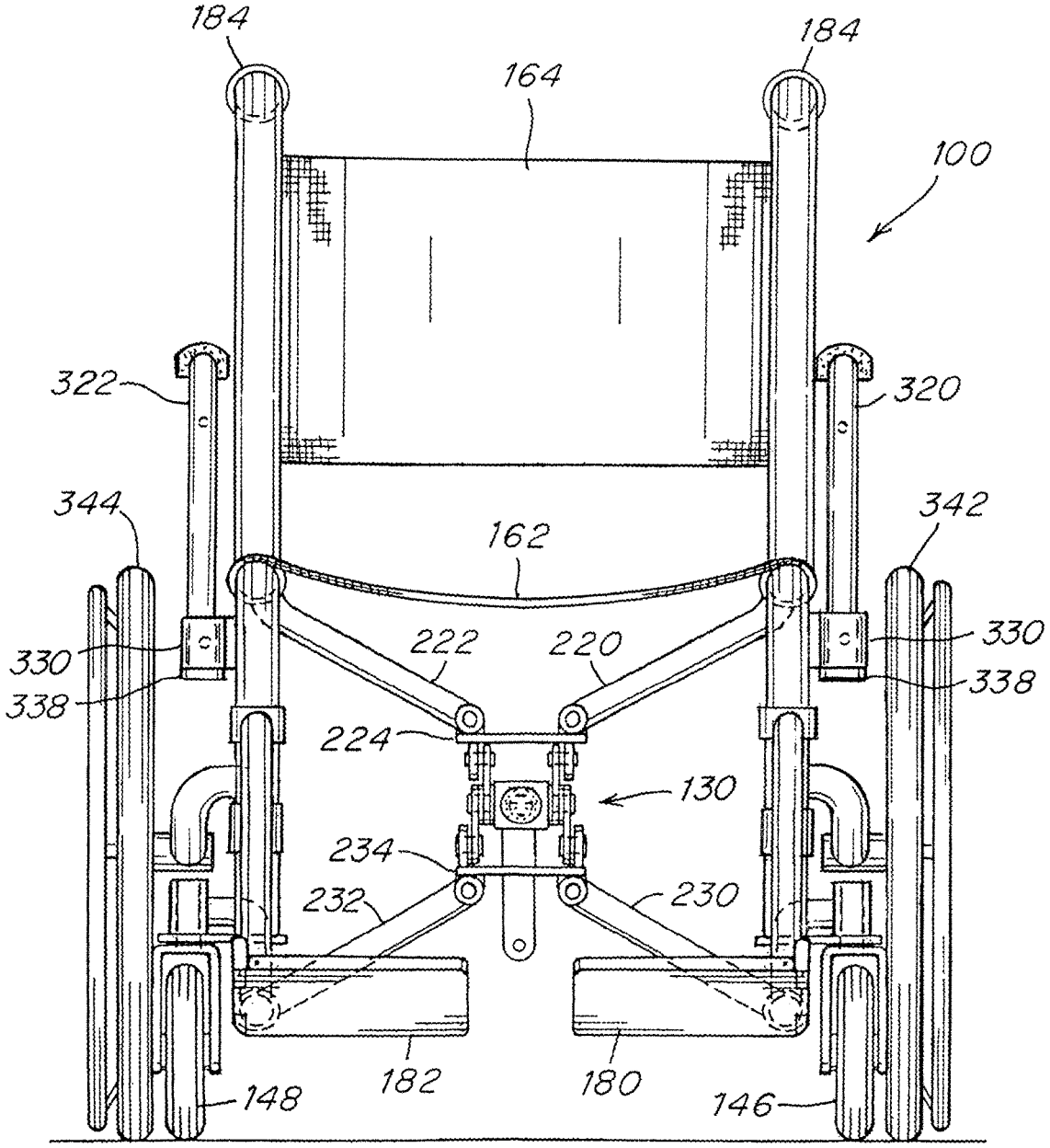
FIG. 10 is a front view of the wheelchair of FIG. 9 in the lowered position.
Figure 11:
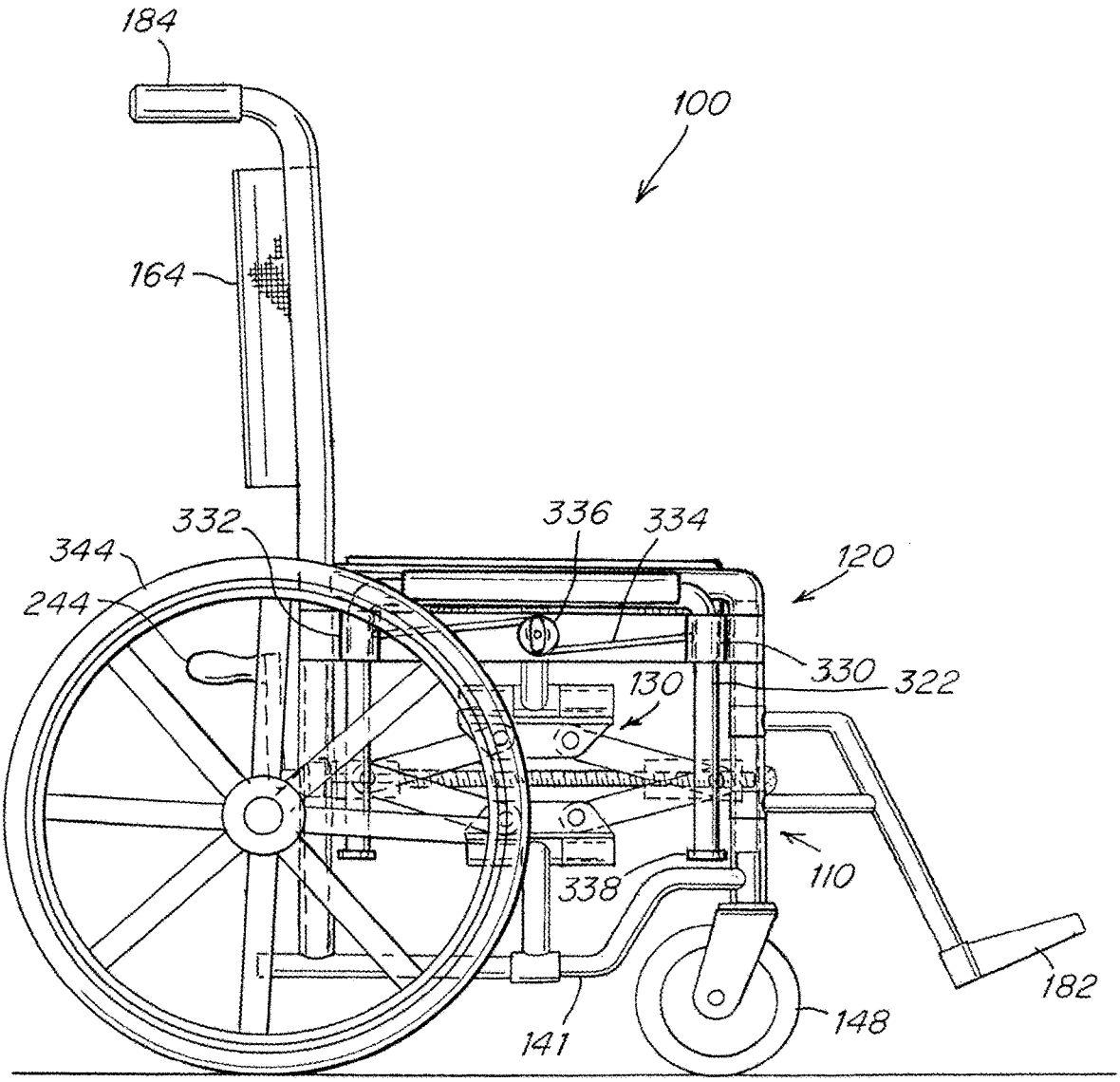
FIG. 11 is a side view of a wheelchair with the armrest lowered, showing use of a transfer board.

Further embodiments of the lift mechanism are shown in FIG. 8. In FIG. 8, the lift mechanism is electrically operated rather than manually operated. The elements of the wheelchair shown in FIG. 8 may be the same as the elements of the wheelchair shown in FIGS. 1-7 and described above, except for elements of the lift mechanism.

In the embodiment of FIG. 8, the hand crank is replaced with an actuator motor 300 connected to the screw 242 of scissors jack 240. The actuator motor 300 is electrically connected to a battery pack 310, which may be mounted to the lower assembly 110. Upon operation of a switch 312, the actuator motor 300 rotates the screw 242 so as to raise or lower the upper assembly 120 relative to the lower assembly 110. The battery pack 310 preferably includes rechargeable batteries.

The battery pack 310 may include a charger for recharging the batteries. The lift mechanism may further include a power cord for connection of the battery charger to a power source, such as a power source in the vehicle or in a fixed location such as a building or a charging station. In further embodiments, the actuator motor 300 may be a DC motor, an AC motor, or any other device suitable for raising and lowering the upper assembly 120. In additional embodiments, the actuator motor 300 can be directly connected to a power source in the vehicle or in a fixed location, thereby bypassing or eliminating the need for a battery.

Further embodiments of the wheelchair are illustrated in FIGS. 9-12. The wheelchair of FIGS. 9-12 may be the same as the wheelchair of FIGS. 1-7, except for the configuration of the armrest and the diameter of the rear wheels. The wheelchair of FIGS. 9-12 includes a left armrest 320 and a right armrest 322 which are slidable upwardly and downwardly to permit transfer of the user to a vehicle or other location. The right armrest 322 is shown in the conventional armrest position in FIGS. 9 and 10 and in the transfer position in FIGS. 11 and 12. The armrest 322 slides upwardly and downwardly in guides 330 and 332. A latch 334 holds the armrest 322 in the conventional armrest position. The latch 334 may be released by a release mechanism 336. Stops 338 may be affixed to the lower ends of armrest 322 to provide a stop during upward movement of armrest 322.

Figure 12:
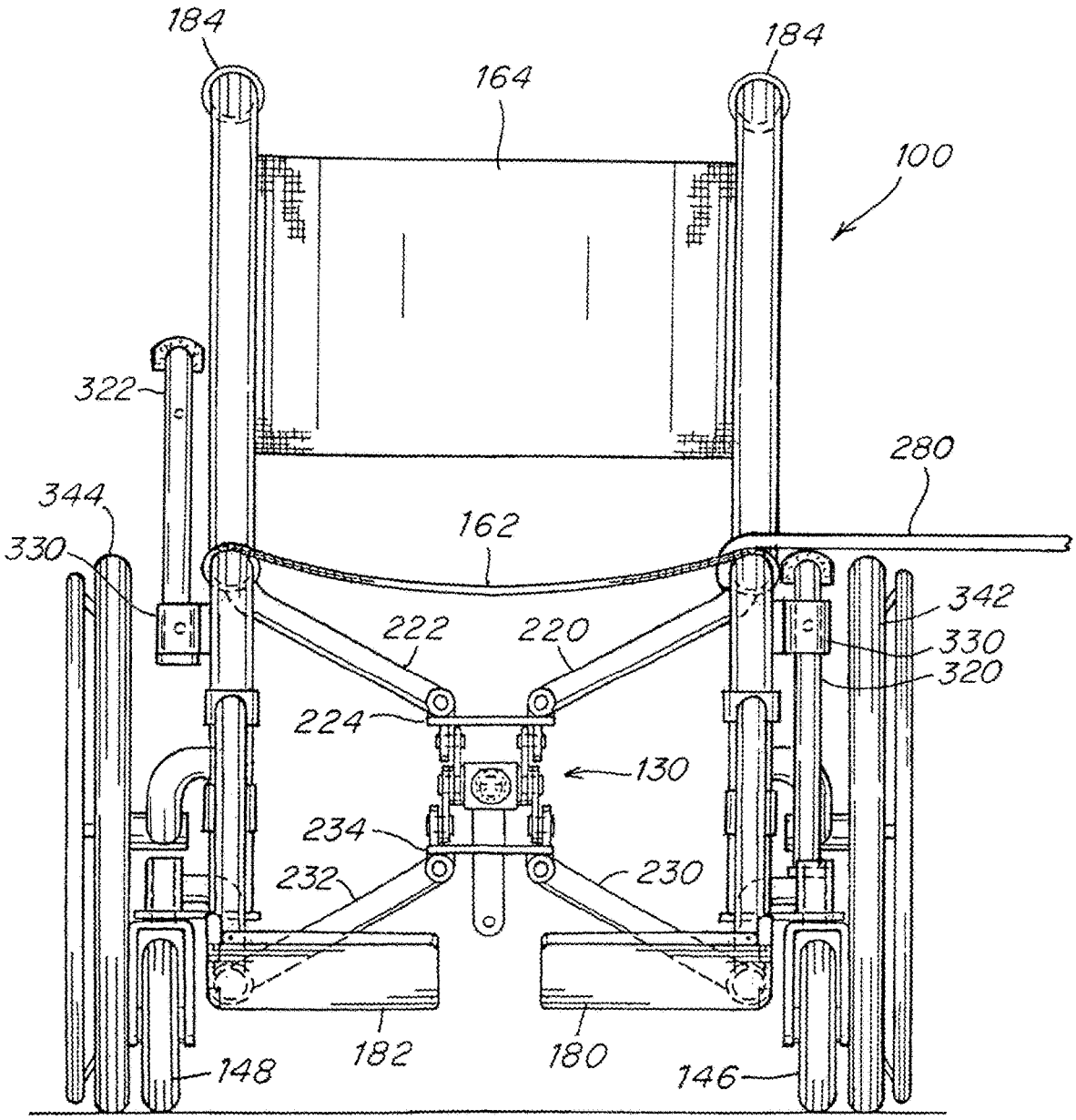
FIG. 12 is a front view of the wheelchair of FIG. 11, showing use of the transfer board.

An advantage of the armrests shown in FIGS. 9-12 is that larger diameter rear wheels 342 and 344 may be utilized on the wheelchair, since the armrests 320 and 322 are not required to pivot outwardly and downwardly for transfer of the user. The diameter of the wheels is selected to permit the transfer board 280 to rest on the upper frame level with the seat 162, as best shown in FIG. 12.

Figure 13:
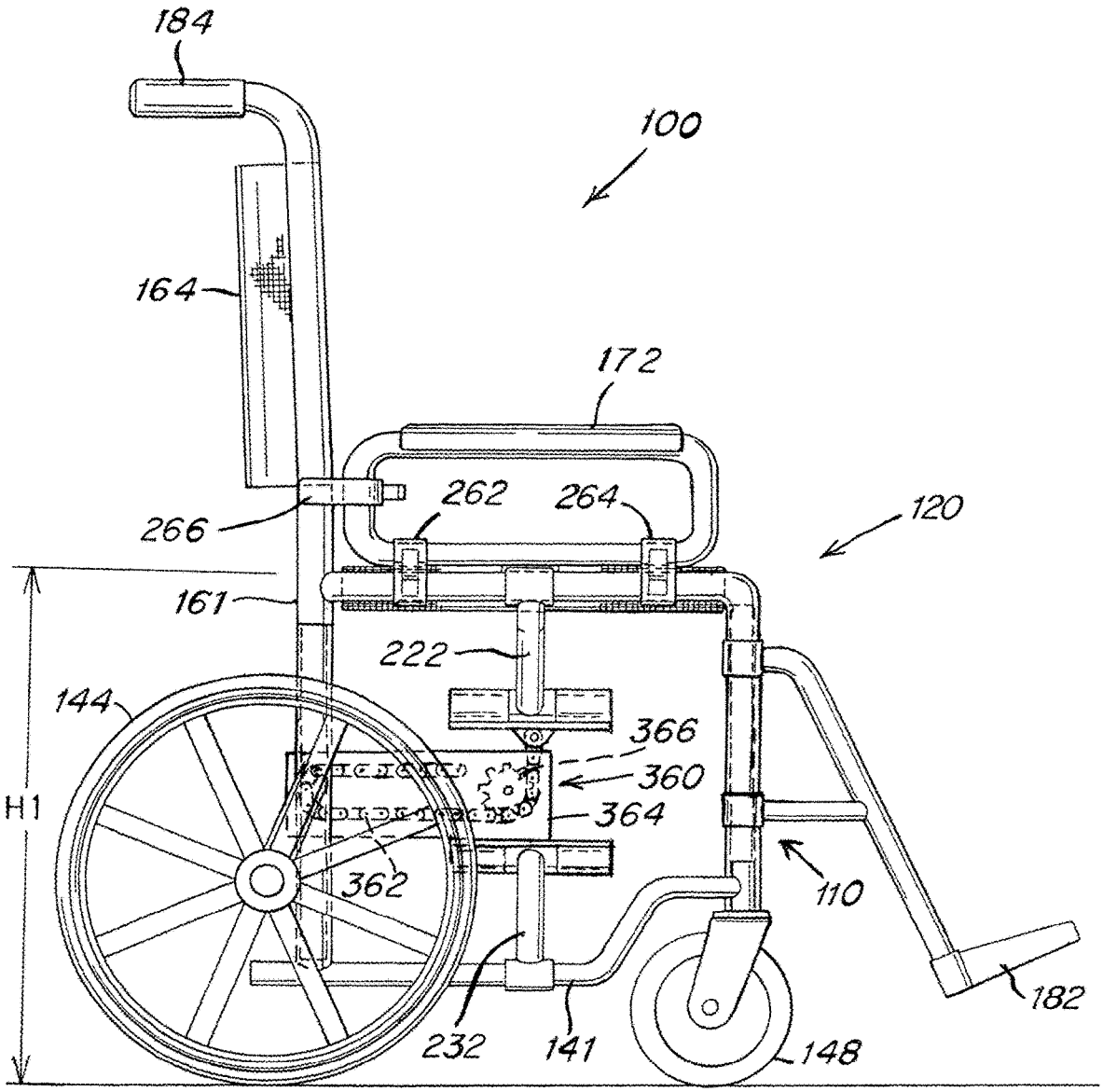
FIG. 13 is a side view of a wheelchair including a linear chain actuator drive system, in the lowered position.
Figure 14:
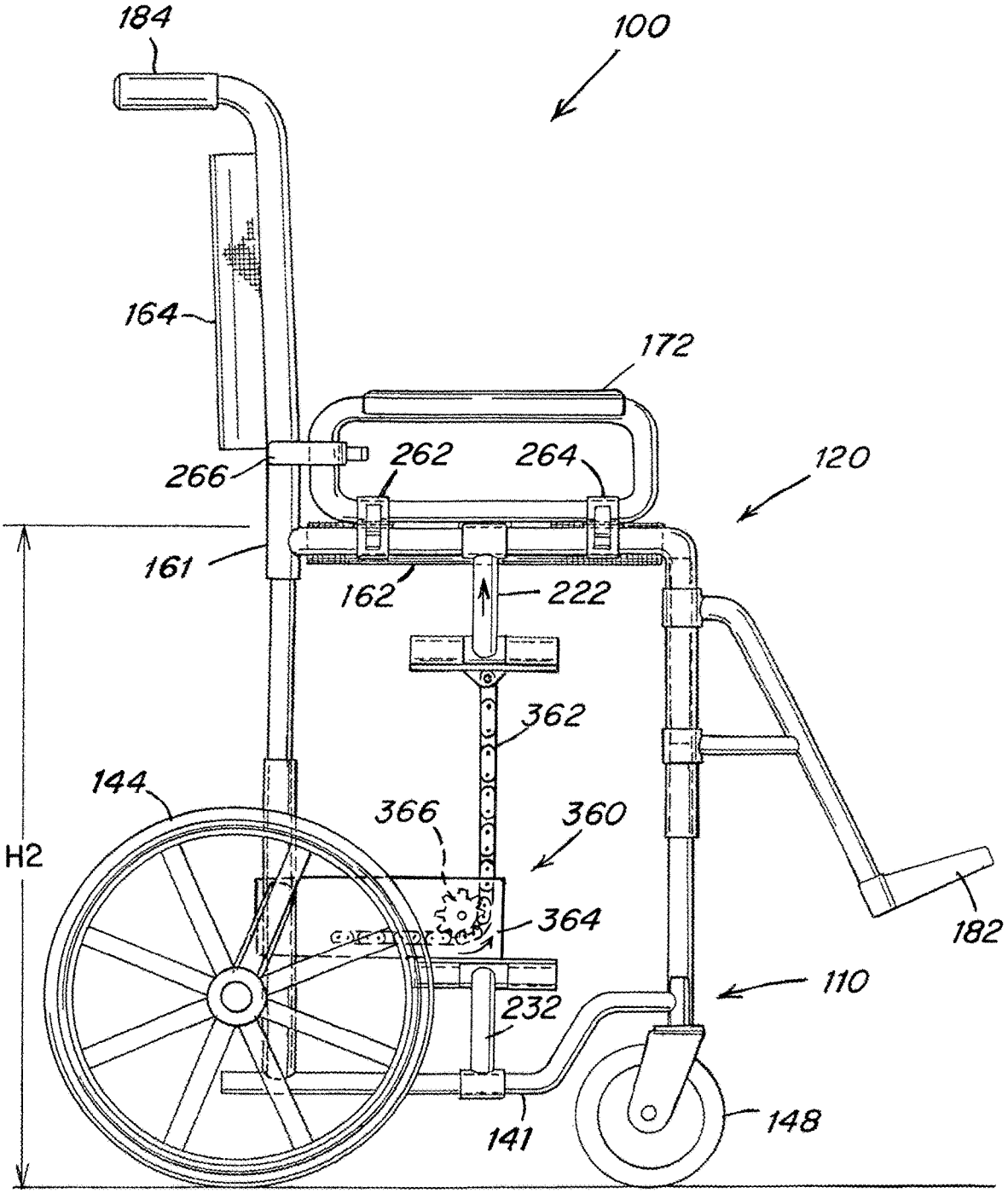
FIG. 14 is a side view of the wheelchair of FIG. 13, in the raised position.

Further embodiments of the wheelchair are shown in FIGS. 13 and 14. The wheelchair of FIGS. 13 and 14 may be the same as the wheelchair of FIGS. 1-7, except for the configuration of the lift mechanism. In the embodiment of FIGS. 13 and 14, the lift mechanism 130 comprises a linear chain actuator drive system 360. The linear chain actuator drive system 360 includes a linear chain 362, a motor 364 and a sprocket 366. A battery pack (not shown) is also provided for operation of the motor 364. The linear chain actuator drive system 360 can move the upper assembly 120 between a lowered position, as indicated by level H1 in FIG. 13, and a raised position, as indicated by level H2 in FIG. 14.

In further embodiments, the lift mechanism 130 can be a linear actuator, such as a DC linear actuator. One suitable linear actuator is a type MMP LA3-12V-40-A-200, available from Midwest Motion Products.

It will be understood that the lift mechanism 130 may include a variety of different mechanisms for raising and lowering the upper assembly 120 relative to the lower assembly 110. The lift mechanism may be manually operated, electrically operated or hydraulically operated, for example, and may include any suitable lift device.

Figure 15:
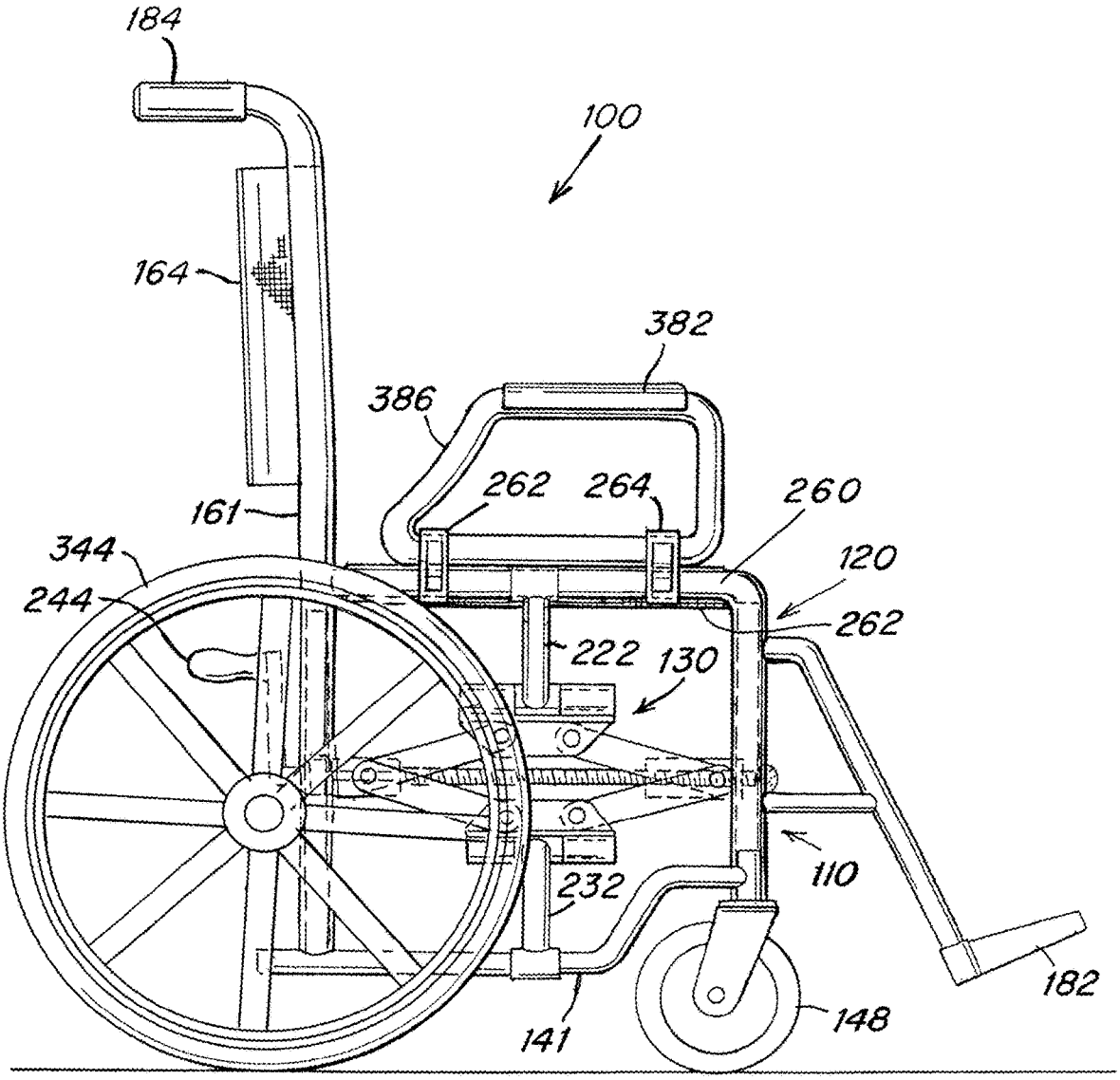
FIG. 15 is a side view of a wheelchair in accordance with additional embodiments.

Further embodiments of the wheelchair are shown in FIG. 15. The wheelchair of FIG. 15 may be the same as the wheelchair of FIGS. 1-7 except for the configuration of the armrests. In particular, the wheelchair of FIG. 15 includes a right armrest 382 having a contoured shape in a region 386 to permit pivoting outwardly and downwardly without interference with the rear wheel 144. The contour of the right armrest 382 may be selected in accordance with the size and position of the rear wheel 144, as shown in FIG. 15.

Figure 16:
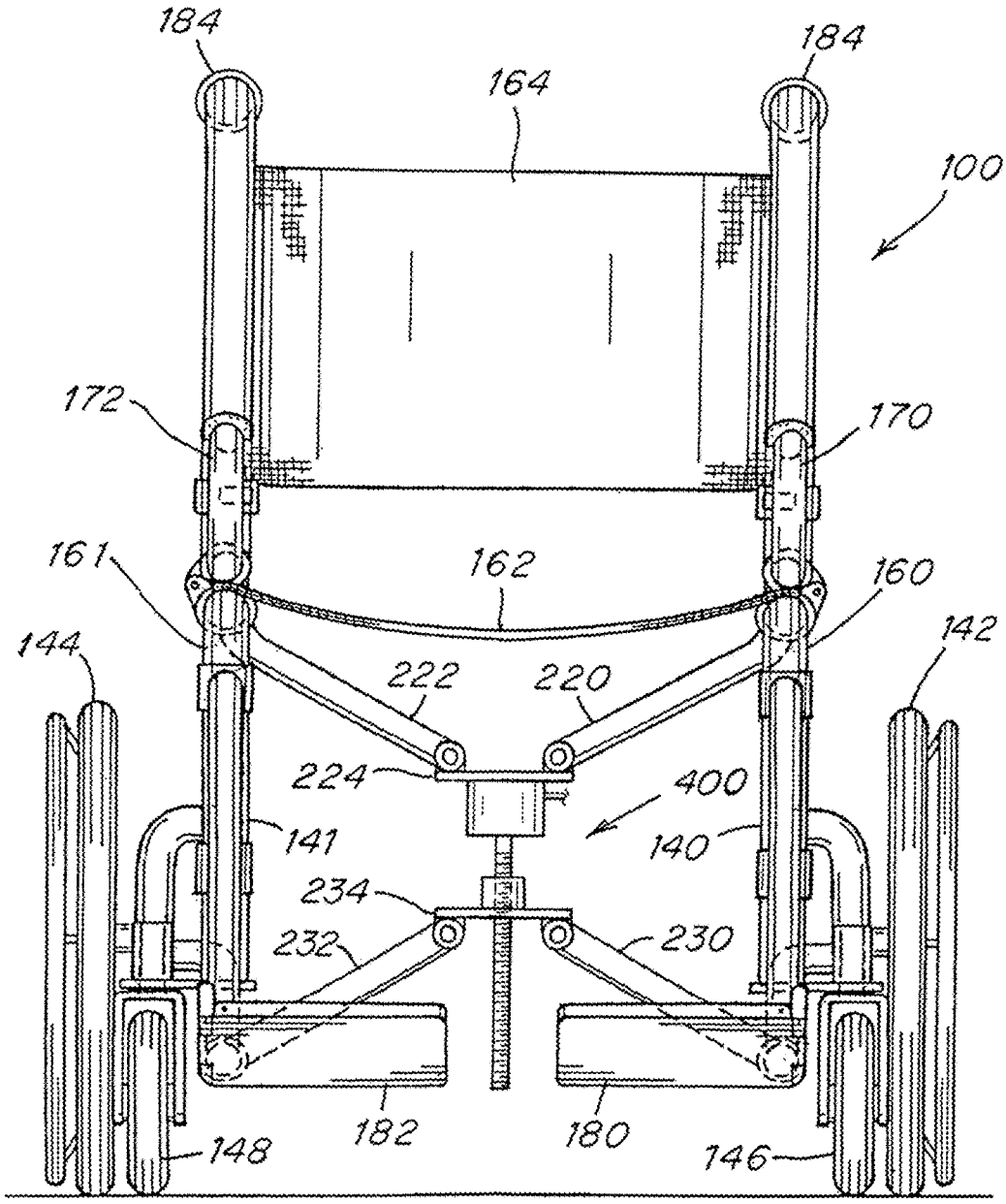
FIG. 16 is a front view of a wheelchair in accordance with additional embodiments.
Figure 17:
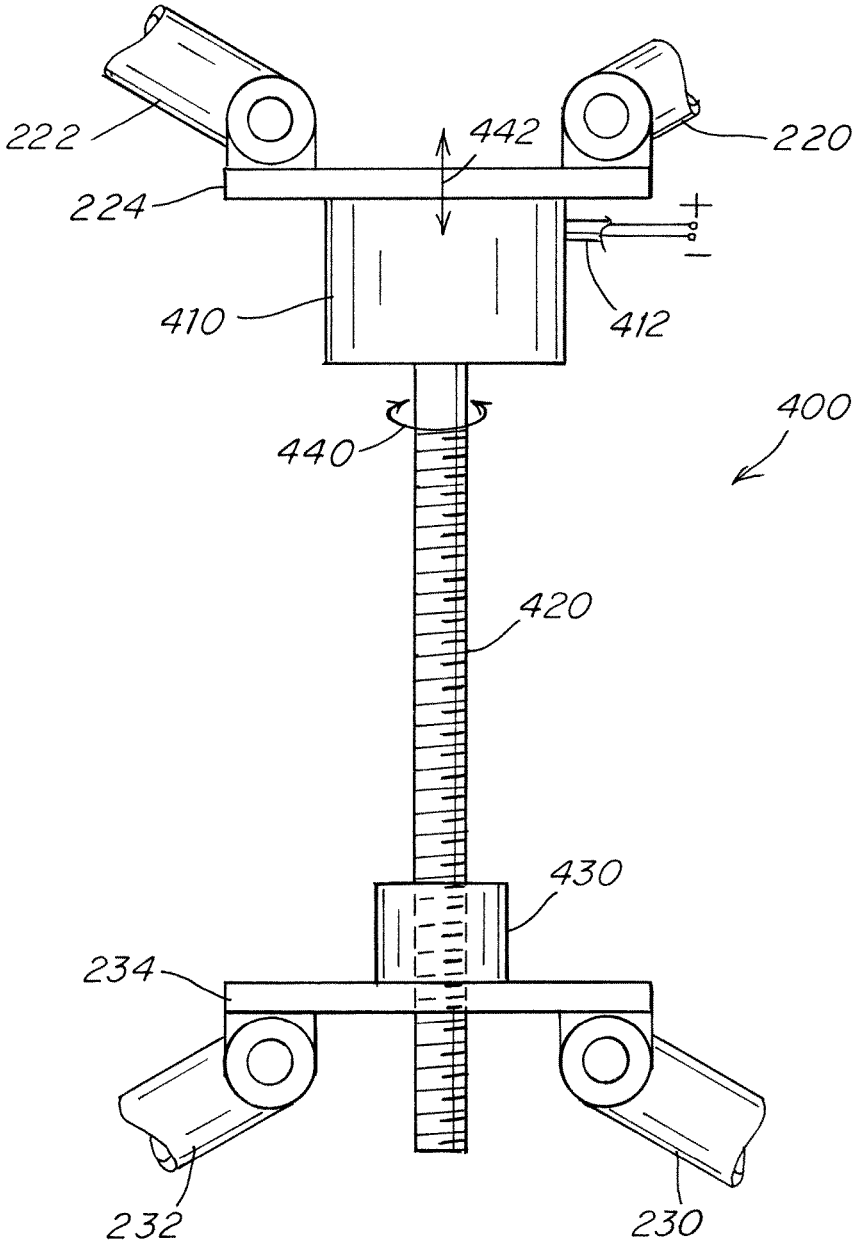
FIG. 17 is an enlarged view of the motor assembly shown in FIG. 16.

Additional embodiments of the wheelchair are shown in FIGS. 16 and 17. The wheelchair of FIGS. 16 and 17 may be the same as the wheelchair of FIGS. 1-7, except for the configuration of the lift mechanism. Therefore, the descriptions of the elements of the wheelchair other than the lift mechanism will not be repeated.

The wheelchair of FIGS. 16 and 17 includes a motor assembly 400 connected between the upper lift element 224 and the lower lift element 234. By operation of the motor assembly, the upper assembly 120 (FIG. 1) is raised and lowered relative to the lower assembly 110 (FIG. 1).

The motor assembly 400 includes a motor 410 affixed to the upper lift element 224, a threaded shaft 420 and a ball screw 430. The threaded shaft 420 is attached to motor 410 and passes through ball screw 430. The ball screw 430 is affixed to lower lift element 234. A power cord 412 connects motor 410 to a power source, such as the battery pack 310 shown in FIG. 8. The motor 410 can be connected to any suitable power source, such as a battery mounted on the wheelchair. It will be understood that the configuration of the motor assembly 400 can be reversed, such that motor 410 is affixed to lower lift element 234 and ball screw 430 is affixed to upper lift element 224.

In operation, the motor 400 is energized, causing threaded shaft 420 to rotate about its longitudinal axis, as indicated by arrow 440 in FIG. 17. The rotation of threaded shaft 420 causes ball screw 430 to move upwardly or downwardly along the threaded shaft 420, thereby raising or lowering the upper lift element 224 relative to the lower lift element 234, as indicated by arrow 442 in FIG. 17. The rate of raising or lowering the upper lift element 224 relative to the lower lift element 234 is determined by the speed of rotation of motor 410 and by the design of threaded shaft 420.

In one example, the motor 410 may be of a type used to raise and lower seats in a vehicle. However, the motor 410 can be any suitable motor that is capable of raising and lowering a patient seated in the wheelchair at a moderate speed that does not startle the patient. In some embodiments, the ball screw can be replaced with a nut that is affixed to lower lift element 234 but is mounted for rotation relative to lower lift element 234. Furthermore, the motor assembly 400 is not limited to the use of a threaded shaft and ball screw, but can utilize any suitable linear actuator mechanism.

Thus far, the disclosed technology has been described in connection with wheelchairs. However, the technology can be utilized with other chair types, including but not limited to transport chairs. Transport chairs have smaller rear wheels than wheelchairs and are designed primarily for transport of patients by the caregiver.

Having thus described at least one illustrative embodiment of the invention, various alterations, modifications and improvements will readily occur to those skilled in the art. Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A wheelchair comprising:

a lower assembly including a lower frame having wheels rotatably mounted thereto;

an upper assembly including an upper frame supporting a seat, a backrest and at least one movable armrest; and a motor assembly configured to move the upper assembly relative to the lower assembly between a lowered position and a raised position, wherein a user can move sideways out of the seat in the raised position with the movable armrest lowered, wherein the lower frame and the upper frame include telescoping frame members and wherein the telescoping frame members include a first tube of a first diameter and a second tube of a second diameter, wherein the first diameter is different from the second diameter.

2. The wheelchair according to claim 1, wherein the motor assembly includes a motor coupled to one of the upper assembly and the lower assembly, a ball screw coupled to the other of the upper assembly and the lower assembly, and a threaded shaft connected between the motor and the ball screw.

3. The wheelchair according to claim 1, wherein the motor assembly comprises a linear actuator.

4. The wheelchair according to claim 1, wherein the lower assembly, the upper assembly and the motor assembly are configured to enable folding of the wheelchair for storage and/or transport.

5. The wheelchair according to claim 1, wherein the movable armrest pivots downwardly.

6. The wheelchair according to claim 1, wherein the movable armrest is hinged to the upper frame to permit pivotal movement.

7. The wheelchair according to claim 1, wherein the movable armrest is slidable upwardly and downwardly.

8. The wheelchair according to claim 5, wherein the armrest is contoured to clear the wheels during pivotal movement.

9. The wheelchair according to claim 1, wherein the upper assembly includes upper struts pivotally connected between the upper frame and the motor assembly.

10. The wheelchair according to claim 9, wherein the lower assembly further includes lower struts pivotally connected between the lower frame and the motor assembly.

11. The wheelchair according to claim 1, wherein the motor assembly is configured to enable adjustment of the seat to an intermediate position between the lowered position and the raised position.

12. The wheelchair according to claim 1, further comprising a transfer board that engages the upper frame with the movable armrest lowered.

13. The wheelchair according to claim 1, wherein the lower frame includes a lower left frame and a lower right frame, each connected to the motor assembly, and wherein the upper frame includes an upper left frame and an upper right frame, each connected to the motor assembly.

14. The wheelchair according to claim 13, wherein the lower left frame and the lower right frame are pivotally connected to the motor assembly by lower struts and wherein the upper left frame and the upper right frame are pivotally connected to the motor assembly by upper struts.

15. The wheelchair according to claim 1, further comprising a battery connected to the motor assembly, a battery charger and a power cord for connection of the battery charger to a power source in a vehicle and/or a fixed location.

16. A chair comprising:

a lower assembly including a lower frame having wheels rotatably mounted thereto;

an upper assembly including an upper frame supporting a seat, a backrest and at least one movable armrest; and a motor assembly configured to move the upper assembly relative to the lower assembly between a lowered position and a raised position, wherein a user can move sideways out of the seat in the raised position with the movable armrest lowered, wherein the lower frame and the upper frame include telescoping frame members and wherein the telescoping frame members include a first tube of a first diameter and a second tube of a second diameter, wherein the first diameter is different from the second diameter.

17. The chair according to claim 16, wherein the motor assembly includes a motor coupled to one of the upper assembly and the lower assembly, a ball screw coupled to the other of the upper assembly and the lower assembly, and a threaded shaft connected between the motor and the ball screw.

18. The chair according to claim 16, further comprising a battery connected to the motor assembly, a battery charger and a power cord for connection of the battery charger to a power source in a vehicle and/or a fixed location.

* * * * *